US009138607B2

(12) United States Patent
Miranda et al.

(10) Patent No.: US 9,138,607 B2
(45) Date of Patent: Sep. 22, 2015

(54) PORTABLE PULLEY TRAINING SYSTEM

(71) Applicants: Migdoel Miranda, Cedar Park, TX (US); Ruben Serrano, North Miami, FL (US)

(72) Inventors: Migdoel Miranda, Cedar Park, TX (US); Ruben Serrano, North Miami, FL (US)

( * ) Notice: Subject to any disclaimer, the term of this patent is extended or adjusted under 35 U.S.C. 154(b) by 189 days.

(21) Appl. No.: 13/788,129

(22) Filed: Mar. 7, 2013

(65) Prior Publication Data

US 2013/0267392 A1 Oct. 10, 2013

Related U.S. Application Data

(60) Provisional application No. 61/686,428, filed on Apr. 4, 2012.

(51) Int. Cl.

| | |
|---|---|
| ***A63B 21/00*** | (2006.01) |
| ***A63B 21/062*** | (2006.01) |
| ***A63B 23/00*** | (2006.01) |
| ***A63B 21/06*** | (2006.01) |
| ***A63B 71/02*** | (2006.01) |
| ***A63B 21/072*** | (2006.01) |
| ***A63B 21/16*** | (2006.01) |
| ***A63B 21/28*** | (2006.01) |
| *A63B 71/06* | (2006.01) |

(52) U.S. Cl.

CPC ..... *A63B 21/06* (2013.01); *A63B 21/072* (2013.01); *A63B 21/1469* (2013.01); *A63B 21/154* (2013.01); *A63B 21/16* (2013.01); *A63B 21/28* (2013.01); *A63B 71/02* (2013.01); *A63B 21/0726* (2013.01); *A63B 21/1627* (2013.01); *A63B 2021/169* (2013.01); *A63B 2071/0694* (2013.01); *A63B 2209/10* (2013.01); *A63B 2210/50* (2013.01)

(58) Field of Classification Search

USPC ..... 482/102, 92–94, 99–101; 434/247, 302; 601/23, 24, 33–35; 602/32–36, 38; 473/274–277, 450, 458, 464, 229, 409, 473/430, 437, 443, 453, 424–425

See application file for complete search history.

(56) References Cited

U.S. PATENT DOCUMENTS

| | | | | |
|---|---|---|---|---|
| 2,937,023 | A * | 5/1960 | Seymour et al. | 482/92 |
| 4,974,836 | A * | 12/1990 | Hirsch | 482/40 |
| 7,963,893 | B1 | 6/2011 | Cruz et al. | |
| 8,075,462 | B1 | 12/2011 | Hinds et al. | |
| 2010/0101973 | A1 * | 4/2010 | Kim | 206/579 |
| 2011/0287906 | A1 * | 11/2011 | Morris | 482/102 |
| 2013/0244840 | A1 * | 9/2013 | Thompson | 482/93 |

* cited by examiner

*Primary Examiner* — Loan H Thanh
*Assistant Examiner* — Megan Anderson
(74) *Attorney, Agent, or Firm* — Trop, Pruner & Hu, P.C.

(57) ABSTRACT

A portable pulley training system includes a cable having a first end and a second end, a first handle adapted to the first end of the cable to enable a first user to control movement of the cable, the second end of the cable configured to be coupled to a resistance element, a pivot pulley to be moveably adapted about the cable at a first location between the ends, an anchor pulley to be moveably adapted about the cable at a second location between the first location and the second end, a first retention member associated with the pivot pulley to control positioning of the pivot pulley, the first retention member configured to be controlled by a second user, and a second retention member associated with the anchor pulley to control positioning of the anchor pulley with respect to an anchor point.

11 Claims, 6 Drawing Sheets

PORTABLE PULLEY TRAINING SYSTEM

This application claims priority to U.S. Provisional Patent Application No. 61/686,428 filed on Apr. 4, 2012 entitled "Portable Pulley Training System," the disclosure of which is hereby incorporated by reference.

FIELD OF THE INVENTION

Embodiments of the present invention relate to exercise equipment and, more particularly, to a portable training system in the health and fitness field.

BACKGROUND

Cable pulley machines (cable cross over) are common pieces of exercise equipment in many gyms. These machines typically include a large weight stack (with associated supports) and a pulley bracket that affixes to this support and through which a cable feeds. While these cable pulley machines are in great demand in gyms, they are not readily made portable, preventing a user from being independent of going to the gym in order to use this one cable pulley machine.

Rubber elastic bands are used to solve the problem of portability and to provide exercise to individuals. However, these elastic bands cannot be compared in any way to a weight resistance device. Anatomically, it cannot achieve what the gravity-fighting weight can do.

SUMMARY OF THE INVENTION

In accordance with embodiments of the present invention, there is provided a portable pulley training system that is both functional and easy to carry anywhere in a small bag. Portability is a key of this product.

This product can be used to create a movement to stimulate Personal Trainers to have their own place or move outdoors, yet getting the same benefits that they get in the gym. All of that, without sharing their fee with a corporation. This product has been quietly desired by trainers and fitness enthusiasts alike.

This device can be used with any kind of weight, adjust faster to any position to manage a load from different points, thus targeting a desired angle to improve muscle function. It can be used for rehabilitation or sport training, among others. It is very compact for what it does.

Simply bring it in the carrying bag and place an anchor point in an elevated structure and begin to exercise.

It would be advantageous to provide a portable pulley training system because it can be used virtually anywhere.

It would also be advantageous to provide a portable pulley training system because it helps on avoiding commuting to the gym to exercise, saving gas. It can be used at the park or at lunch time in the office.

It would further be advantageous to provide a portable pulley training system because it is set to perform virtually any exercise.

In an embodiment, a portable pulley training system includes a cable having a first end and a second end, a first handle adapted to the first end of the cable to enable a first user to control movement of the cable, where the second end of the cable is configured to be coupled to a resistance element, a pivot pulley to be moveably adapted about the cable at a first location between the first and second ends, an anchor pulley to be moveably adapted about the cable at a second location between the first location and the second end, a first retention member associated with the pivot pulley to control positioning of the pivot pulley, the first retention member configured to be controlled by a second user, and a second retention member associated with the anchor pulley to control positioning of the anchor pulley with respect to an anchor point.

As an example, the first user is a client and the second user is a trainer. The system enables the client to perform different exercises. In one configuration, the pivot pulley is configured to be affixed in a first position substantially at ground level to enable the client to perform a first exercise, the pivot pulley is configured to be maintained in a middle position by the trainer to enable the client to perform a second exercise, and the pivot pulley is configured to be unrestrained to enable the client to perform a third exercise.

In one implementation, the first retention member is a second handle and the second retention member is a strap or a carabineer. Also, the resistance element may be one or more weights.

A kit may be formed of a portable bag and the cable, the first handle, the pivot pulley, the anchor pulley, and the first and second retention members.

In another example, the training system includes a cable having a first end and a second end, a first handle adapted to the first end of the cable to enable a first user to control movement of the cable, where the second end of the cable is configured to be coupled to a resistance element, a pivot pulley to be moveably adapted about the cable at a first location between the first and second ends, the pivot pulley housed in a first bracket configured to a first locking member, a second handle coupled to the pivot pulley via the first locking member to control positioning of the pivot pulley, the second handle configured to be controlled by a second user, and an anchor pulley to be moveably adapted about the cable at a second location between the first location and the second end, the anchor pulley housed in a second bracket configured to a second locking member to adapt the anchor pulley to an anchor point.

Another aspect is directed to a method that includes affixing a resistance element to a second end of a cable of a portable pulley training system, the resistance element selected by a trainer from multiple resistance elements based on client ability, maintaining, via a second handle of the system held by the trainer, the pivot pulley about the cable at a first location, and enabling the client to perform a first exercise by movement of the first handle adapted to the first end of the cable to control movement of the cable, where the anchor pulley is coupled to an anchor point at a second location between the first location and the second end of the cable.

As examples, the client is facing the system to perform the first exercise, the client is lateral to the system to perform a second exercise, and a backside of the client is facing the system to perform a third exercise. For example, the first exercise is a squat, the second exercise is a lateral twist, and the third exercise is a triceps exercise.

DETAILED DESCRIPTION

Figure 1:
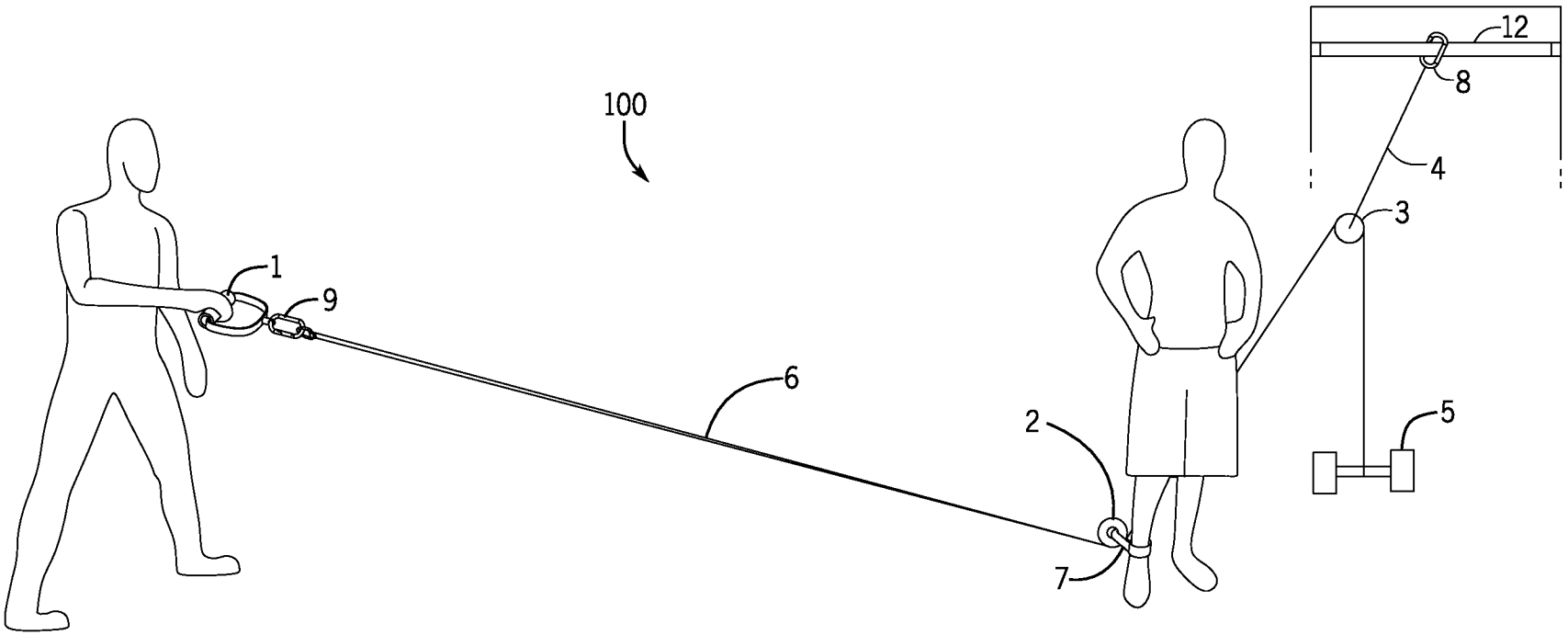
FIG. 1 is a perspective view of a portable pulley training system 100 in accordance with an embodiment of the present invention.

Referring now to FIG. 1, shown is a perspective view of a portable pulley training system 100 in accordance with an embodiment of the present invention. As shown in FIG. 1, training system 100 generally includes a cable 6 having a first end to be accessed by a user or client and a second end to support a weight or other resistance element. In various embodiments, cable 6 may be formed of a coated aluminum cable. In addition to cable 6, a plurality of pulleys may be included in the training system. Specifically, a first pulley 2 corresponds to a pivot pulley, and a second pulley 3 corresponds to an anchor pulley.

As seen in FIG. 1, the first end of cable 6 couples to a handle 1 to enable manipulation by a client. As described further below, in various embodiments cable 6 couples to handle 1 via a hook 9 or other fastener. Note that in other embodiments, and/or in addition to providing a handle, a training system can include other user interface mechanisms. Although the scope of the present invention is not limited in this regard these other mechanisms can include a multi-handed handle, a bar, a strap or any other user interface mechanism to enable a user to manipulate and move cable 6 in a desired manner.

Figure 1B:
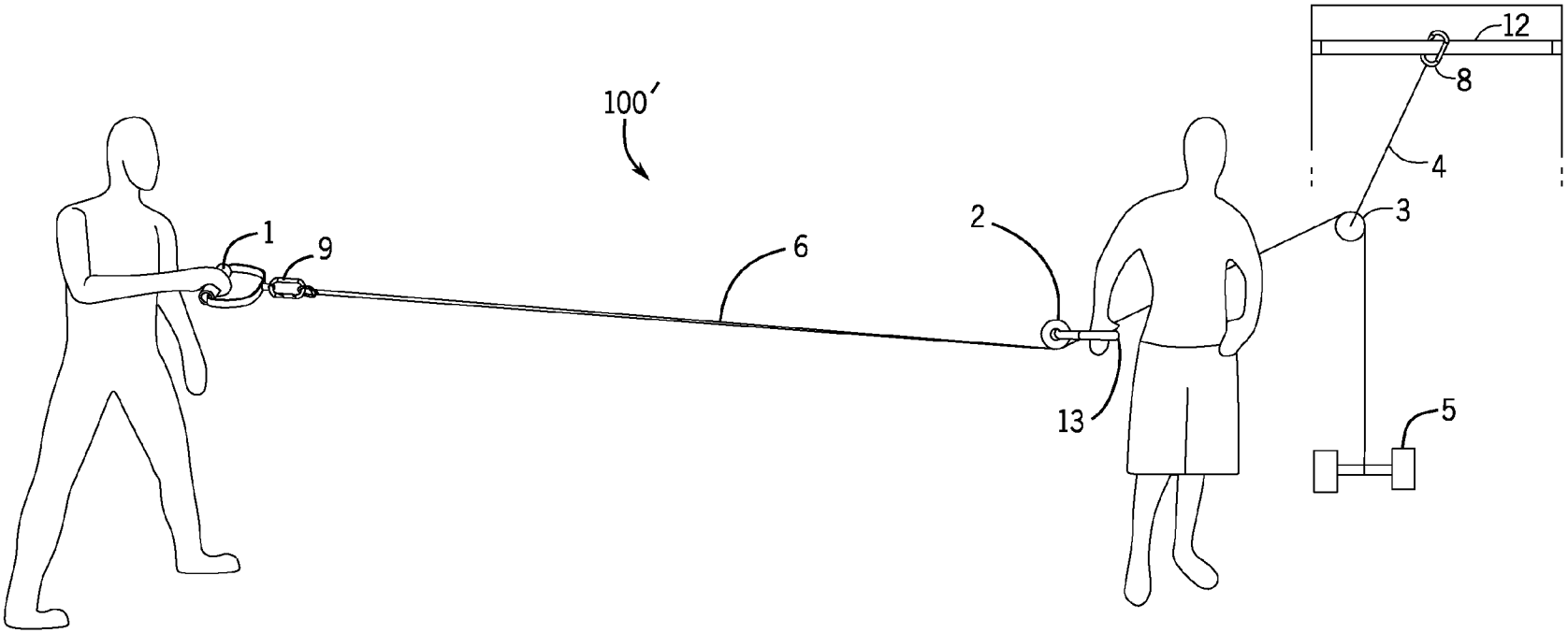
FIG. 1B is another perspective view of a portable pulley training system in accordance with an embodiment of the present invention.

Pivot pulley 2 and anchor pulley 3 may similarly adapt about the cable by means of a bracket or other support member that in turn can be interconnected, e.g., via a hook or other fastener to a corresponding strap, handle, or other retention member. In the illustration shown in FIG. 1, a trainer or client partner can control location of pivot pulley 2 by way of a strap 7. In the illustration shown in FIG. 1B of training system 100', the trainer or client partner can control location of pivot pulley 2 by way of a handle 13. With reference back to FIG. 1, similarly, anchor pulley 3 may adapt to an anchor point 12 by way of a corresponding anchor strap 4. In the illustration of FIG. 1, anchor point 12 may be a familiar pull up bar, e.g., affixed within a door frame or other suitable location. Of course other types of anchor points are possible. Finally with reference to FIG. 1, weight 5 or other type of resistance may attach to the second end of cable 6 by way of another hook, strap or other fastener.

In operation, a variety of different exercises can be performed by appropriate placement of the client, pivot pulley 2, anchor pulley 3, and weight 5. In general, via anchor strap 4, anchor pulley 3 may be adapted to an appropriate fixed structure, which in various embodiments may be elevated at a height of between approximately 2 and 20 feet. In addition, an appropriately sized weight 5 for a given client may be adapted to the second end of cable 6. Further, in usage situations in which a trainer or client partner is present, appropriate positioning of pivot pulley 2 at any one of a variety of points, e.g., from a low point to a mid-point to an unlocked or floating point can occur. Further even when a trainer or client partner is not present, pivot pulley 2 may be affixed into an appropriate position by way of a given retention mechanism, such as a corresponding hook that can be anchored into a floor, wall or other appropriate location.

Using different combinations of weights, location of anchor and pivot pulleys and client positioning to effect desired angles and appropriate resistance, a client can engage in a variety of different exercises. Although the scope of the present invention is not limited in this regard, example exercises possible using a portable pulley training system include: single arm push (chest), squats (legs), biceps curls (biceps), dead lift (legs), lateral raises (shoulders), wood chops (obliques/abdominals), single arm pull (back), lunges (legs), triceps curls (triceps), front raises (shoulder), single arm fly (rear shoulder).

For some of these exercise patterns, a client may face forward toward the remainder of the training system. For other exercise patterns, the client may face laterally to the training system and in still further cases the client may face backwards from the training system.

To provide guidelines for a client, various markings may be placed at different locations of the cable to identify target zones for location of pivot pulley 2 and anchor pulley 3. Furthermore, note that in some implementations instead of providing a single cable, multiple cables can be provided each of varying lengths. These cables may be coupled together via hooks or other connections members to enable different sizes of cables to accommodate different clients and different exercise patterns.

Thus in different exercise patterns, a client may pull, push, twist, squat or dead lift using the portable pulley training system. Various multi-joined exercises also may be performed using the portable pulley training system.

By providing multiple pulleys within the portable training system, free movement of the cable can be realized so that a client's movements can be natural and fluid, regardless of the amount of weight being moved and whether an additional partner or trainer is present or not.

Using a portable training pulley training system in accordance with an embodiment of the present invention, a client can perform exercises in a physiologically correct manner such that as an exercise movement begins, a maximum highest tension or weight is realized and as a client moves the cable closer towards the body, the tension naturally reduces (in contrast to exercise band operation).

Thus in the illustration of FIG. 1, the system is being pulled by an actual fitness enthusiast and is being held by an actual trainer. The handle 1 is being held by client/partner and is attached to coated cable 6 in order to move the weight 5 through pivot pulley 2 and anchor pulley 3 with assistance from anchor strap 4 to be moved up and down or as desired. It is also used to manage the tempo in which it moves. The handle 1 is attached to the cable by hook 9. In one embodiment, the pivot pulley 2 is made out of plastic, but note that it can also be made out of iron, wood, metal or other suitable material. Pivot pulley 2 is used to move and manage where the resistance of the weight 5 comes from, e.g., up, down or from the middle. The pivot pulley 2 is attached to the coated cable 6 by a hook 7 that can be made out of plastic, rubber, wood, iron or other suitable material.

In one embodiment, the anchor pulley 3 is made out of plastic, but can also be made out of iron, wood, metal or other suitable material that allows the device to be functional. Anchor pulley 3 can be attached to an elevated structure and it allows room for the device to be used properly by pivot pulley 2. Anchor pulley 3 is attached to the anchor strap 4 by a metal hook 8 that can be made out of iron, wood, rubber, metal or other suitable material in various embodiments.

The anchor strap 4 can be made out of rope material, Velcro™ or other suitable material that can hold resistance. Anchor strap 4 holds anchor pulley 3 and allows it to make the portable pulley training system functional and to move freely.

Coated cable 6 cooperates to make all parts moving in harmony and flowing without dangerous friction. Other types of cables such as small boat rope, etc. may be used.

In one embodiment, the portable pulley training system weighs 7 pounds and it can be made lighter or heavier as needed.

Coated cable 6 goes through handle 1 and attaches again on coated cable 6 to form a loop in order to make the cable to stay together with the handle 1. The loop is held together by a metal fastener 9. The process is repeated to hold the end of the cable with metal fasteners in order to hold a metal hook that holds the weight 5. A handle if implemented to control placement of pivot pulley 2 is used exactly as handle 1.

Coated cable 6 in an embodiment may be 20 feet long, but it can be functional at 19, 18, 17, 16, 15, 14 or any other value desired.

The portable pulley training system works similarly to an elastic band or a cable machine at the gym, but with more advantages to the user. These elements working together in a clean, dry area works well for the fitness enthusiasts or trainee. The portable pulley training system generally works like exercise bands, but many people that know about exercise know that the body responds better when using weights. It is a natural way of exercising in nature. We pull the load and it becomes easier as it gets close to the body, just like holding a baby. Exercise bands do just the opposite. They get tighter and harder as they approach the body, thus creating discomfort in joints and going against body basic movement.

Figure 2A:
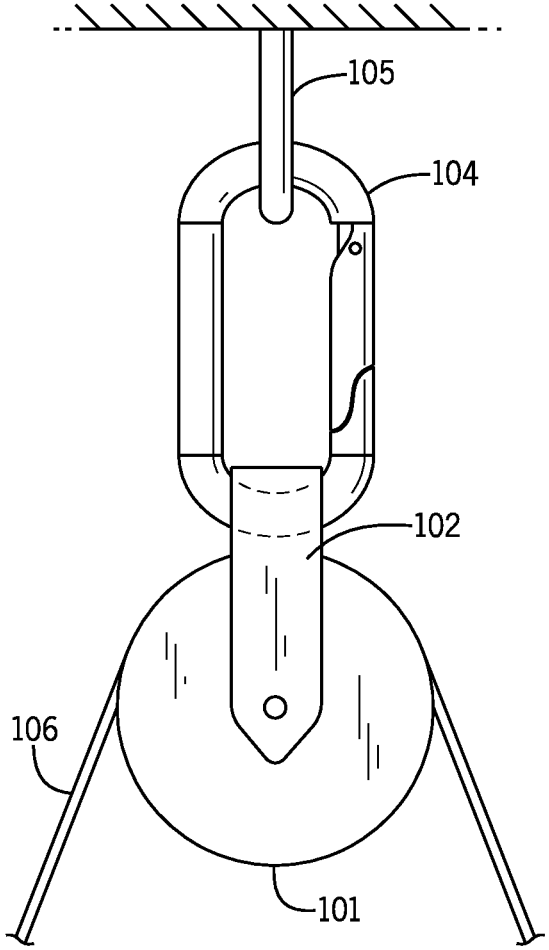
FIG. 2A is a close up illustration of an anchor pulley in accordance with an embodiment.

Referring now to FIG. 2A, shown is a close up illustration of an anchor pulley in accordance with an embodiment. As shown in FIG. 2A, anchor pulley 101 is housed in a bracket 102 that provides an interface for connection of a retention member which in the embodiment shown in FIG. 2A is a carabiner 104. Note that instead of a carabiner, a different type of retention mechanism such as another type of hook, strap or other such means may be provided. As further shown in FIG. 2A, an anchor point 105 may correspond to a hook affixed to a ceiling, which may be implemented via another carabiner or other interconnect member. Note that cable 106 thus travels around pulley 101.

Figure 2B:
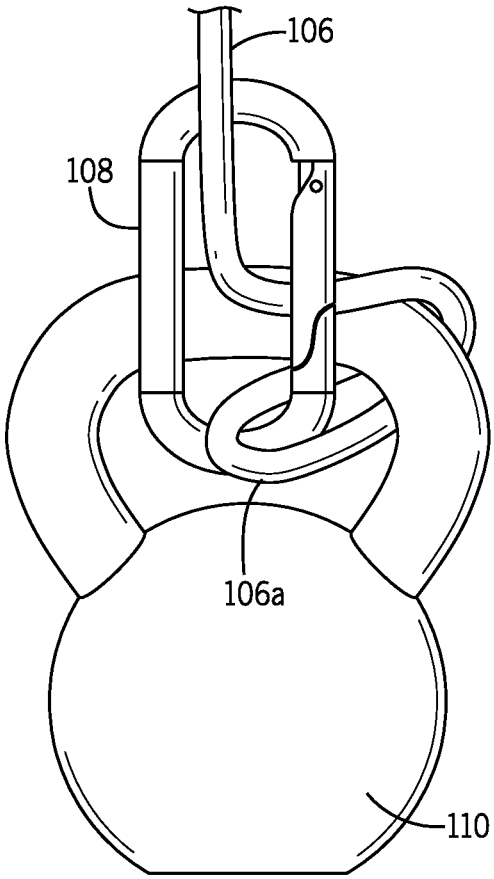
FIG. 2B is a close up illustration of interconnection of a cable to a weight in an embodiment.

Referring now to FIG. 2B, shown is a close up illustration of interconnection of cable 106 to a weight 110, which in the embodiment of FIG. 2B is a kettle bell. Note that in other embodiments the weight can be a dumbbell or any other supportable load. In the embodiment shown, cable 106 may have a looped termination end 106*a* such that a loop is formed to adapt kettle bell 110 to this end of the cable. Note that instead of a carabiner 108 a different type of retention mechanism may be provided.

Figure 2C:
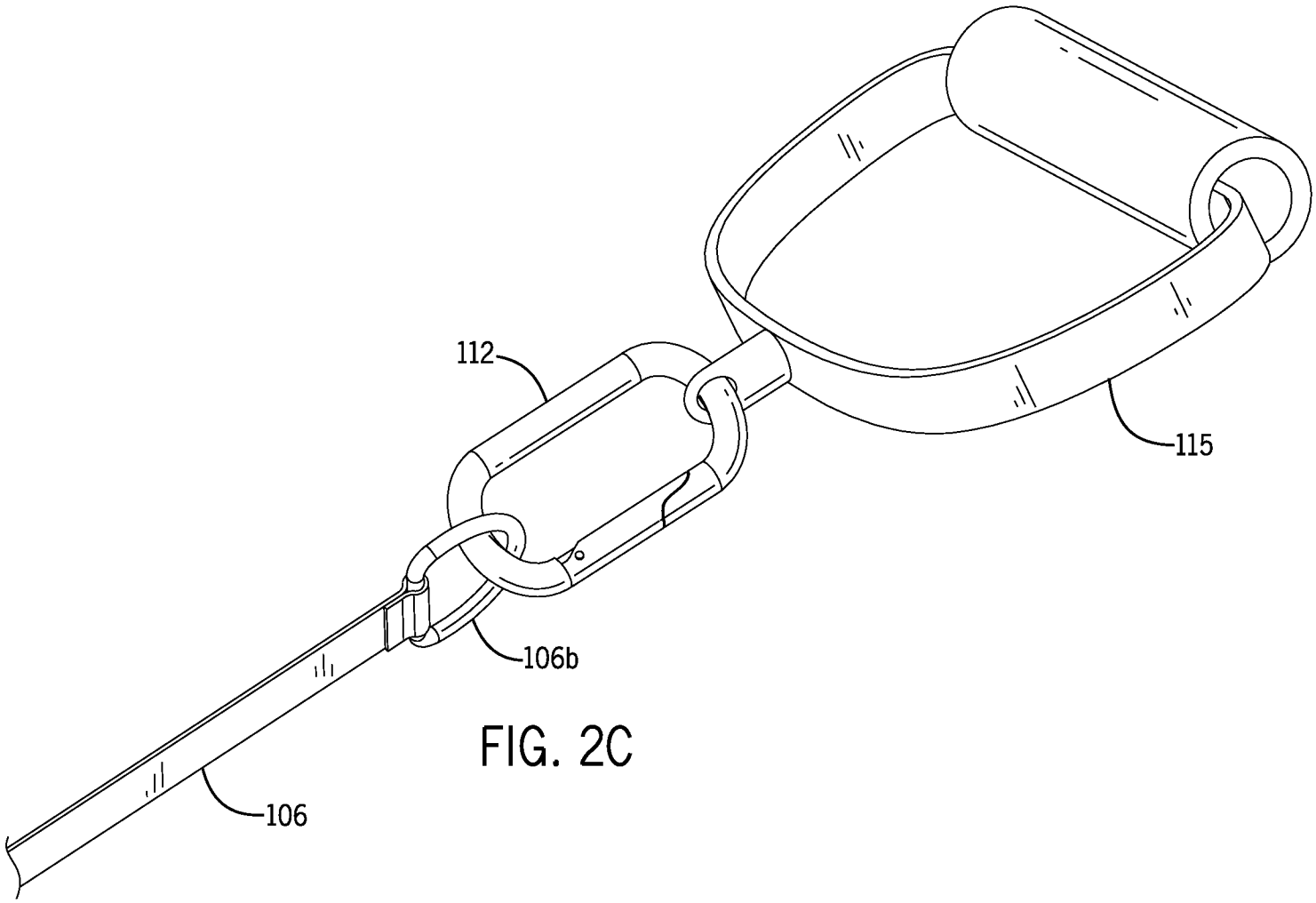
FIG. 2C is a close up illustration of an end of a cable in accordance with an embodiment of the present invention.

Referring now to FIG. 2C, shown is a close up illustration of the other end of a cable in accordance with an embodiment of the present invention. As shown in FIG. 2C, cable 106 includes another end 106*b* that also terminates in a loop. Note that in different embodiments, the cable can be soldered, braised or otherwise joined together to form this loop. Or, the cable may be threaded through a dual opening bracket and retained, e.g., by way of screw or other retention member. As seen, loop 106*b* couples to a carabiner 112 that in turn connects to handle 115. Of course instead of the carabiner a different type of hook or other retention mechanism can be provided, and another user interface other than a handle may be present in other embodiments. Alternately, looped end 106*b* may be directly configured to handle 115.

As examples of the types of exercise patterns that can be performed, in a first exercise, a client may face the rest of the portable pulley training system to perform an exercise such as a bicep curl, squat, or a pull exercise. For another type of exercise such as a lateral twist, the user may be laterally positioned with respect to the rest of the portable pulley training system. And for other types of exercises such as a triceps exercise, the user may face away from the remainder of the portable training system. Of course, understand that various positionings of a client, a trainer, the pulleys and weights can be affected in different embodiments.

Figure 3:
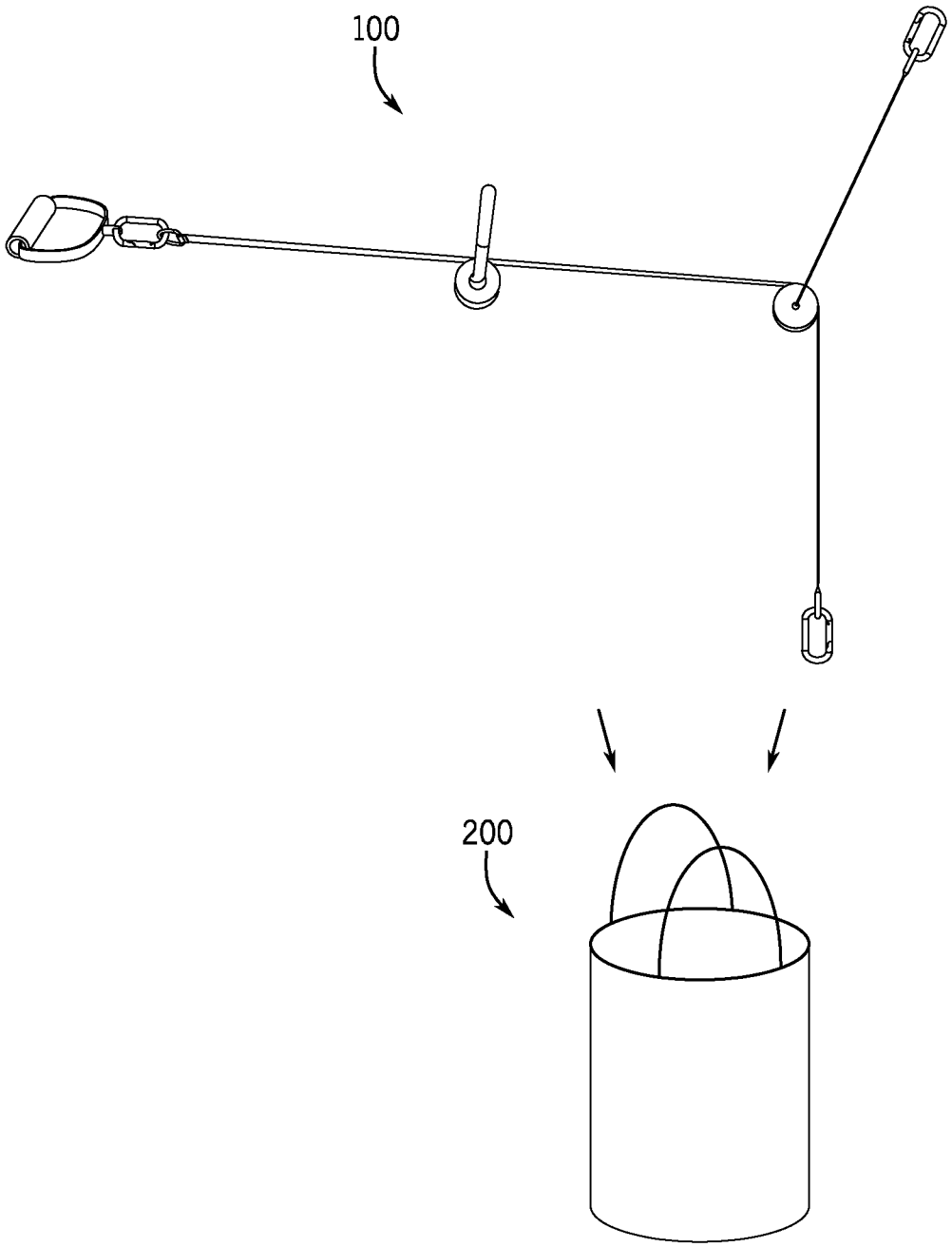
FIG. 3 is an illustration of a kit in accordance with an embodiment of the present invention.

Referring now to FIG. 3, illustrated is a kit in accordance with an embodiment of the present invention. As shown in FIG. 3, training system 100 can be carried about as a kit that is formed of a portable bag 200 which can be used to carry training system 100.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A portable pulley training system comprising:

a cable having a first end and a second end;

a first handle attached to the first end of the cable to enable a first user to control movement of the cable, wherein the second end of the cable is configured to be coupled to a resistance element;

a pivot pulley to be moveable along a length of the cable at a first location between the first and second ends;

an anchor pulley to be moveable along the length of the cable at a second location between the first location and the second end;

a first retention member associated with the pivot pulley to control positioning of the pivot pulley, the first retention member configured to be controlled by a second user to control the positioning of the pivot pulley during an exercise by the first user, the first user separate from the second user and the resistance element, the second user separate from the first user and the resistance element, wherein the first user is a client and the second user is a trainer, wherein the pivot pulley is configured to be affixed in a first position substantially at ground level to enable the client to perform a first exercise, and wherein the pivot pulley is configured to be maintained in a middle position by the trainer to enable the client to perform a second exercise, the middle position above the first position; and a second retention member associated with the anchor pulley to control positioning of the anchor pulley with respect to an anchor point.

2. The system of claim 1, wherein the portable pulley training system is to enable the client to perform a plurality of different exercises.

3. The system of claim 1, wherein the pivot pulley is configured to be unrestrained in which the pivot pulley is floating to enable the client to perform a third exercise.

4. The system of claim 1, wherein the first retention member comprises a second handle and the second retention member comprises a strap or a carabiner.

5. The system of claim 1, wherein the resistance element comprises one or more weights.

6. The system of claim 1, further comprising a kit formed of a portable bag and the cable, the first handle, the pivot pulley, the anchor pulley, and the first and second retention members.

7. A method comprising:

affixing a resistance element to a second end of a cable of a portable pulley training system, the resistance element selected by a trainer from a plurality of resistance elements based on ability of a client, the portable pulley training system including a cable, a pivot pulley, an anchor pulley, a first handle and a second handle;

maintaining, via the second handle held by the trainer, the pivot pulley about the cable at a first location; and enabling the client to perform a first exercise by movement of the first handle adapted to the first end of the cable to control movement of the cable, wherein the anchor pulley is coupled to an anchor point at a second location between the first location and the second end of the cable.

8. The method of claim 7, wherein the client is facing the portable pulley training system to perform the first exercise.

9. The method of claim 8, wherein the client is lateral to the portable pulley training system to perform a second exercise.

10. The method of claim 9, wherein a backside of the client is facing the portable pulley training system to perform a third exercise.

11. The method of claim 10, wherein the first exercise comprises a squat, the second exercise comprises a lateral twist, and the third exercise comprises a triceps exercise.

* * * * *